United States Patent [19]

Wallner et al.

[11] 3,977,914

[45] Aug. 31, 1976

[54] METHOD OF DEFORMATION-FREE QUENCHING OF WORK-PIECES HEATED TO HARDENING TEMPERATURE

[75] Inventors: Felix Wallner; Franz Oberhauser, both of Linz; Heinz Mildner, Traun; Heinrich Rudelstorfer, Waxenberg; Berndt Drexler, Linz; Franz Klicnik, Traun, all of Austria

[73] Assignee: Vereinigte Osterreichische Eisen- und Stahlwerke-Alpine Montan Aktiengesellschaft, Linz, Austria

[22] Filed: July 18, 1974

[21] Appl. No.: 489,937

[30] Foreign Application Priority Data

July 24, 1973 Austria ..... 6513/73

[52] U.S. Cl. ..... 148/12.4; 148/36; 148/38; 148/143; 148/153

[51] Int. Cl.[2] ..... C21D 1/18

[58] Field of Search ..... 148/143, 149, 153, 12.4, 148/36, 38

[56] References Cited

UNITED STATES PATENTS 2,726,181 12/1955 Lyon ..... 148/153

2,765,161 10/1956 Mungall ..... 148/149

*Primary Examiner*—R. Dean

*Attorney, Agent, or Firm*—Kurt Kelman

[57] ABSTRACT

The invention relates to a method of deformation-free quenching of work pieces having a free flange, e.g. boiler bottoms, heated up to hardening temperature, and to a device for carrying out the method. Upon removal from the hardening furnace the work-piece, which has been provided with a plane front surface is placed on a plane supporting construction, then the work-piece and the supporting construction are heated up to hardening temperature and subsequently the supporting construction together with the work-piece resting on it is dipped into a basin filled with quenching liquid. The supporting construction is an annular structure made of austenitic, non-scaling material, wherein in the material no microstructure alteration occurs in the range between the temperature of the quenching liquid and the hardening temperature.

9 Claims, 6 Drawing Figures

METHOD OF DEFORMATION-FREE QUENCHING OF WORK-PIECES HEATED TO HARDENING TEMPERATURE

The invention relates to a method of deformation-free quenching of work-pieces heated to hardening temperature and having a free edge or flange, in particular boiler bottoms and similar pieces of pressed sheets or plates or cast pieces, which pieces have a relatively small wall thickness compared to their diameter and are, after having been taken out of a hardening furnace, dipped into a basin filled with quenching liquid.

Conventionally work pieces, whose wall thickness is relatively small in comparison to their dimensions, have upon removal from the hardening furnace been dipped into a basin filled with a quenching liquid without using a special lifting device.

This kind of quenching leads to a more or less strong deformation of the work-pieces, which e.g. with boiler bottoms has an adverse effect that becomes obvious in an alteration of the border diameter. This deformation is caused by uneven resting of the work-piece in the hardening furnace during heating, by irregular lifting of the work-pieces during transport from the hardening furnace to the quenching device and by a non-uniform chilling of the work-piece. So far it has not been successfully achieved to quench boiler bottoms and similar pieces of pressed sheets or plates and castings having thin walls by simple methods and without deformations occurring. On the contrary; relatively expensive and complicated machines have been necessary which set the work-piece rotating during the quenching procedure and simultaneously support its edge or flange, where a deformation might occur (German Offenlegungsschrift No. 2 100 407). Similar facts apply to the hardening of steel rings (see German Offenlegungsschrift No. 1 508 399).

The invention aims at providing a simple method and a device free from machine drives and easy to produce and to handle for quenching thin-walled bodies, in particular boiler bottoms made of steel without deformations occurring. Thus one wants to eliminate deformations caused by an uneven resting of the work-piece in the furnace, by irregular lifting of the work-piece heated to hardening temperature and by a non-uniform chilling when dipping the work-piece into the quenching liquid. Preventive steps are desirably taken against the formation of air or steam cushions in the hardening of curved work-pieces, so as to improve the quality of the hardened work-piece.

In the method of the invention the work-piece provided with a plane front surface by means of turning, planing or grinding, is set on a plane supporting construction, which is substantially ring-shaped and is made of austenitic and non-scaling material wherein the material being free of a microstructure alteration in the range between the temperature of the quenching liquid and the hardening temperature. The work-piece and the supporting construction are heated to hardening temperature and thereupon the supporting construction together with the work-piece resting upon it is dipped into a basin filled with quenching liquid.

According to a further feature of the invention, in quenching of pieces of pressed sheets or plates or of castings curved upward, enclosed air and/or steam caused by dipping the pieces into the quenching liquid is released through an opening or bore in the work-piece.

A device for carrying out the method of the invention may comprise two concentrically arranged rings of different diameter connected by radial supporting ribs.

It is, however, also possible to use an annular body having lateral stops, wherein possibly for the sake of reinforcement annular ribs or ribs running radially are provided at the lower side of the annular body.

A device particularly suited for closed boiler bottoms consists of a substantially U-shaped pipe conduit penetrating the rings or the annular body, respectively, for draining air and/or steam during quenching, wherein the inlet opening lies in the range of the highest point of the curvature of the pieces of pressed sheets or plates or of the castings and the outlet opening lies at a distance above the level of the quenching liquid.

A special feature consists in that the device is made of austenitic rolled or forged steel which is heat-resisting at least up to hardening temperature.

These and further features of the invention will now be illustrated in more detail by way of example with reference to the accompanying drawings.

Figure 1:
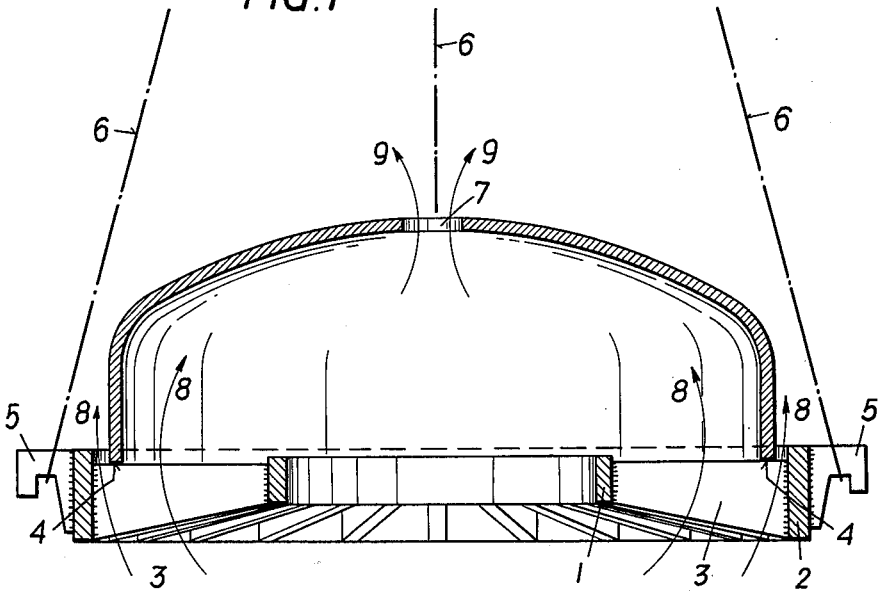
FIG. 1 is a vertical section of a device of the invention, upon which a boiler bottom is set.
Figure 2:
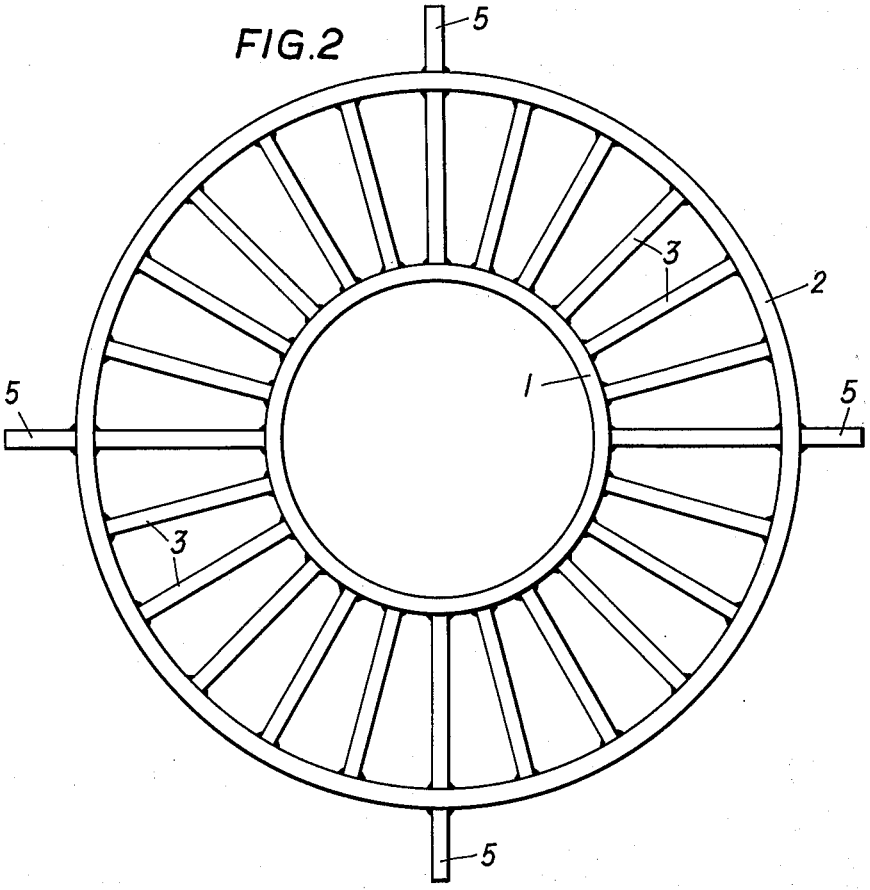
FIG. 2 is a plan view.

The supporting construction for a boiler bottom K according to FIGS. 1 and 2 consists of concentrically arranged rings 1, 2 with supporting ribs 3 arranged radially therebetween. The supporting ribs 3 form a plane supporting surface for front surface 4 of the boiler bottom K. Hooks 5 are secured to the periphery of ring 2 attachment to suspension arrangement 6. In the center of the boiler bottom K, at the highest point of its curvature, an opening 7 is cut out. The border of the boiler bottom, which is not plane after bottom-pressing, is made plane by turning, planing or grinding so that it rests at all points upon the supporting ribs 3. The rings 1, 2 and the supporting ribs 3, as well as possibly the hooks 5 are made of austenitic rolled or forged steel, which is heat-resisting up to the hardening temperature of about 900°C.

For example heat-resisting rolled or forged steels according to "Stahl-Eisen-Werkstoffblatt 470-60" with the material numbers 1.4821, 1.4878, 1.4328, 1.4841, 1.4845, 1.4864 can be used for the production of a welded construction. The aforementioned steels have a chromium-content lying in the range of 16% to 25% and a nickel-content lying in the range of 10% to 33.5%. They have the particular advantage that during thermal treatment they experience no structural alteration and consequently are not at all deformed. The use of such steels for producing a ring-shaped supporting construction is an essential feature of the invention, in particular when the supporting construction is used repeatedly. The boiler bottom K together with the supporting construction is introduced into the hardening furnace by means of a crane or the like, the position according to FIG. 1 being maintained while heating to hardening temperature. For quenching, the supporting construction together with the boiler bottom K resting thereupon is lifted by means of the suspension arrangement 6 and dipped into the quenching liquid in a basin (not illustrated). It is essential that the lifting means only act upon the suspension arrangement and not on the work-piece. The quenching liquid, e.g. water, flows from below through the big opening defined by the diameter of the ring 2 towards the inner wall and equally through the openings between the supporting ribs 3 in direction of the arrows 8; it is passed uniformly towards the entire surface of the work-piece. Air enclosed in the boiler bottom K and any steam bubbles escape through the opening 7 in direction of the arrows 9. After finishing the thermal treatment, the opening 7 is closed by welding a plug into it, unless a manhole or another connection is envisaged in this range for later on.

Thus deformations on account of uneven lifting of the work-piece having reached hardening temperature on account of non-uniform chilling in the quenching liquid are avoided; when testing work-pieces that had been quenched according to the above described method, uniform technological qualities have been found.

Figure 3:
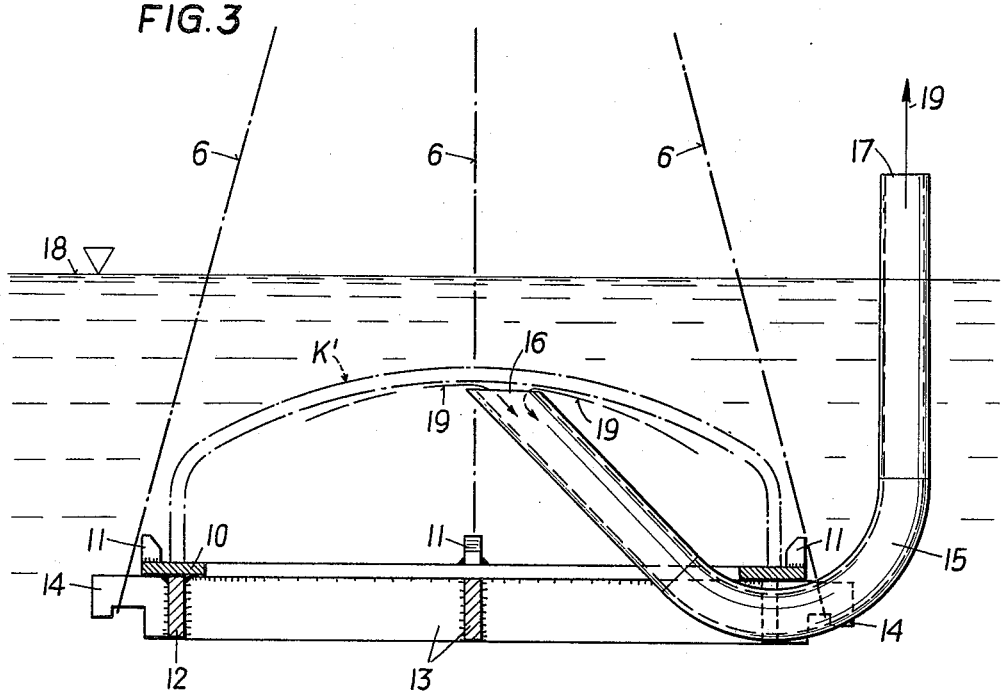
FIG. 3 shows an illustration similar to FIG. 1 for a different embodiment, wherein a pipe for draining air and/or steam from the boiler bottom is provided.
Figure 4:
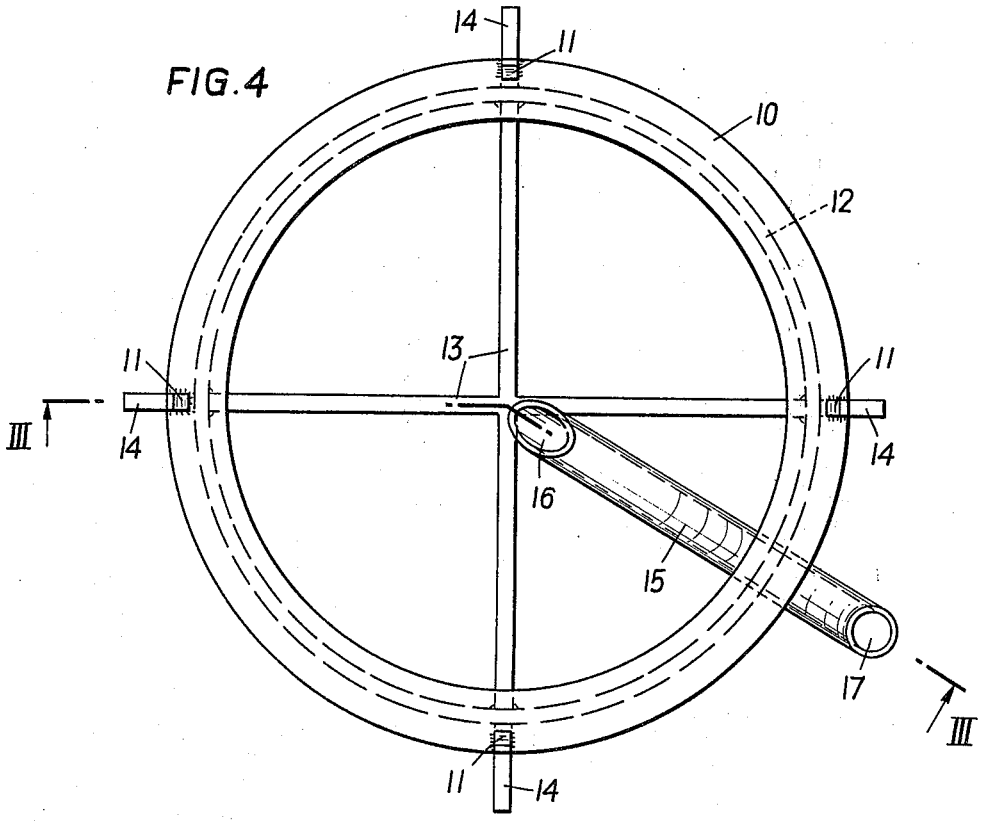
FIG. 4 is a plan view of FIG. 3.

The embodiment of a device of the invention illustrated in FIGS. 3 and 4 comprises an annular body 10 having stops 11, the annular body 10 being reinforced by a vertically attached tube-shaped part 12 and by ribs 13. Below the annular body 10 provided for receiving the closed boiler bottom K′ substantially U-shaped tube 15 is fastened, whose inlet opening 16 lies near the center axis and close below the highest point of the curvature of the boiler bottom K′, whereas the outlet opening 17 lies above the level 18 of the quenching liquid so that air- and steam bubbles can flow automatically, on account of the water pressure, in direction of the arrows 19 into the tube 15 and out of said tube. Of course it is possible to connect a sucking device to the tube 15. The tube 15 is, just the same as the other parts, made of heat-resisting steel and is, together with the supporting construction and the boiler bottom K′, heated and quenched in the above described manner.

Figure 5:
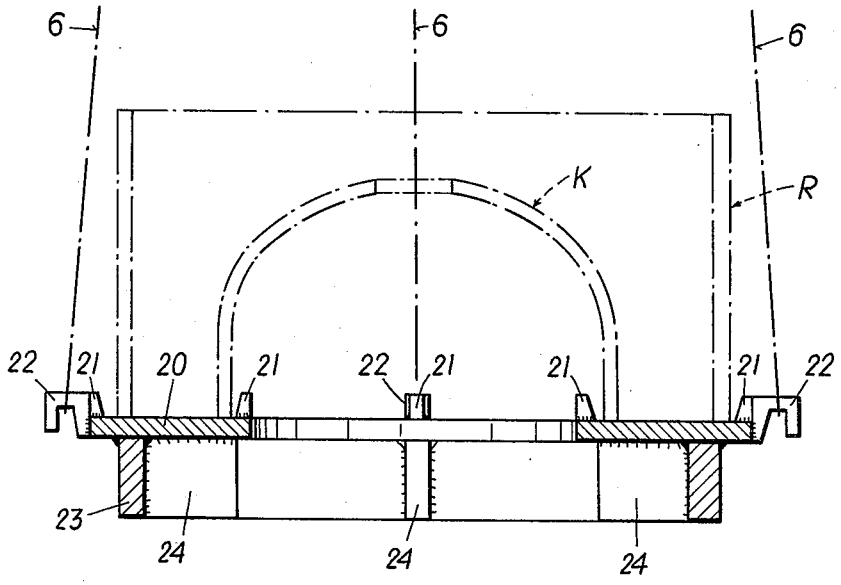
FIGS. 5 and 6 show a vertical section of further embodiments of devices according to the invention.

FIG. 5 illustrates a supporting construction formed by a relatively wide ring 20 having stops 21, a reinforcing flange 23 and radially arranged ribs 24 for boiler bottoms K and tubes R of different diameter, said construction being provided with hooks 22 for a suspension arrangement.

Figure 6:
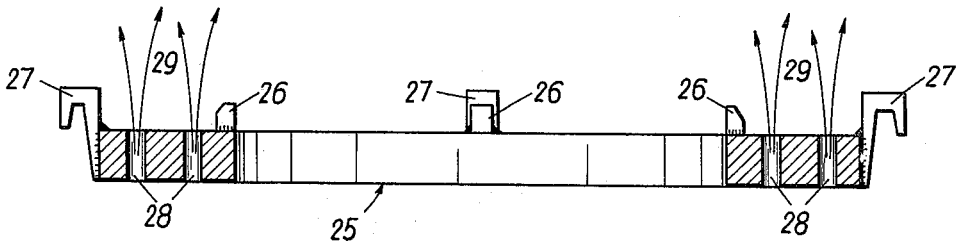

It is also possible, as is shown in FIG. 6, to use as a supporting construction a single, relatively thick annular plate 25 made of austenitic, heat-resisting steel and to do without reinforcing ribs, which reduces the number of welding seams and thus simplifies the production.

To the annular body 25, stops 26 and hooks 27 are welded, the hooks serving also for centering the work-piece. For improving the flow conditions, bores 28 may be provided, through which upon dipping into the quenching-liquid container the quenching liquid flows upward in direction of the arrows 29. Such bores 28 or slits may also be provided in the rings 10, 20 and equally each of the supporting constructions shown in FIGS. 1, 5 and 6 may be connected with a tube 15 according to FIG. 3.

Practical tests with supporting constructions according to FIG. 5, wherein for their production high-tensile austenitic plates of a steel X4 CrNiTi 18 11 in thicknesses of 24 and 52 mm were used, gave extremely favorable results in the treatment of boiler bottoms of a fine-grained structural steel having a reference analysis of 0.20% C, 0.50% Si, 1.7% Mn and about 0.1% Mo, a yield point of at least 58 kp/mm$^2$, and a tensile strength of 72 kp/mm$^2$. By hot-pressing several boiler bottoms were produced which had an outer diameter of 1000 mm, a thickness of 18.0 mm and a weight of 0.2 metric tons, and an outer diameter of 2000 mm, a thickness of 29.5 mm, 48.5 mm and 58.0 mm and a weight of 1.2 metric tons, 2.1 metric tons and 2.5 metric tons, respectively. The hardening temperature was in all cases 900°C, the holding time for bottoms of a diameter of 1000 mm was 0.5 hours and for bottoms of a diameter of 2000 mm 1.0 to 1.5 hours. The bottom borders had been faced and rested fully on the supporting construction — the ring 20 — during the heat treatment. In the bottom centers openings 7 of 100 and 190 mm diameter, respectively, had been provided so that during subsequent quenching in water, air and steam could escape. After austenizing of the boiler bottoms, the time between opening the hardening furnace and dipping the supporting construction, together with the boiler bottom, into the water amounted to 70 to 90 sec. Subsequently the boiler bottoms were tempered to 540°C and 530°C, respectively, with a holding time of 1.3, respectively 2.0 hours, and were then cooled in stagnant air. Before and after quenching and tempering, all bottoms were measured with utmost exactness and it was found that the outer diameters of the boiler bottoms deviated by less than ±0.4% from the desired value, while no alteration occurred in the curvature radii. The bottoms were out of center by 0.15 to 0.55%, the tolerance for pressed bottoms to be out of center amounting up to 1 %. Moreover, the bottoms were found to have good mechanical properties and good tenacity values.

By means of the method of the invention it is also possible to quench and temper boiler bottoms of larger diameter as well as ring-shaped, oval and otherwise shaped bodies of sheets or plates or castings without deformations occurring.

What we claim is:

1. In a method of quenching a work-piece heated to a hardening temperature essentially without deformation, the work-piece having a wall whose thickness is relatively small in comparison to the diameter thereof and the wall of the work-piece terminating in a free flange, quenching being effected by immersing the entire work-piece into a quenching liquid after removal from a hardening furnace, the improvement of 1. working the free flange of the work-piece until it has been planed,
2. setting the planed free flange of the work-piece upon a plane supporting construction to support the work-piece thereon, the supporting construction being
   a. substantially ring-shaped and
   b. of austenitic, non-scaling chromium-nickel steel material wherein no microstructural alteration of the material occurs between the temperature of the quenching liquid and the hardening temperature,
3. heating the supporting construction and the entire work-piece supported thereon to the hardening temperature, and
4. immersing the entire work-piece supported on the supporting construction into the quenching liquid.

2. In the method of claim 1, the steel material having a chromium content of 16% to 25% and a nickel content from 10% to 33.5%.

3. In the method of claim 1, wherein the wall is curved.

4. In the method of claim 3, wherein the curved wall forms a cup-shaped structure and any gaseous fluid enclosed by the cup-shaped work-piece structure being removed.

5. In the method of claim 4, wherein the gaseous fluid is removed through an opening in the work-piece wall.

6. In the method of claim 3, wherein the work-piece is a boiler bottom.

7. In the method of claim 1, wherein the free flange is worked by turning.

8. In the method of claim 1, wherein the free flange is worked by planing.

9. In the method of claim 1, wherein the free flange is worked by grinding.

* * * * *